US006234454B1

(12) United States Patent
Vassioukevitch

(10) Patent No.: US 6,234,454 B1
(45) Date of Patent: May 22, 2001

(54) FAILSAFE DEVICE FOR RAISING/ LOWERING ARTICLES

(76) Inventor: Peter V. Vassioukevitch, 1233 71st St., Brooklyn, NY (US) 11228

( * ) Notice: Subject to any disclaimer, the term of this patent is extended or adjusted under 35 U.S.C. 154(b) by 0 days.

(21) Appl. No.: 09/414,933

(22) Filed: Oct. 9, 1999

Related U.S. Application Data

(63) Continuation-in-part of application No. 08/984,023, filed on Dec. 3, 1997, now abandoned.

(51) Int. Cl.[7] ..... B66D 3/04

(52) U.S. Cl. ..... 254/391; 254/405; 248/125.2; 248/321; 248/322; 24/134 KB; D08/360

(58) Field of Search ..... 248/125.2, 320, 248/321, 332; 254/390, 391, 405, 406, 408, 409, 410, 413, 417; D08/360; 24/134 KB, 131 C, 129 A, 115 A, 115 F, 115 H, 130, 129 B, 128

(56) References Cited

U.S. PATENT DOCUMENTS

| | | | |
|---|---|---|---|
| 152,635 | 6/1874 | Hewitt | 254/391 |
| 669,443 | 3/1901 | Higdon | 254/334 |
| 674,673 | 5/1901 | Danber | 211/117 |
| 723,231 | 3/1903 | Benedict | 254/391 |
| 803,274 | 10/1905 | Deaver | 248/331 |
| 817,039 | 4/1906 | Broome . | |
| 826,727 | 4/1906 | Koorie | 24/115 R |
| 829,320 | 8/1906 | Clark . | |
| 896,646 | 8/1908 | Litsch . | |
| 916,091 | 3/1909 | Batzer | 24/115 R |
| 1,055,503 | 3/1913 | Abrams | 24/115 A |
| 1,107,934 | 8/1914 | Hagan | 188/65.1 |

(List continued on next page.)

FOREIGN PATENT DOCUMENTS

| | | | |
|---|---|---|---|
| 339860 | 9/1959 | (CH) | 24/129 |
| 604339 | 5/1926 | (FR) | 24/128 |

*Primary Examiner*—Donald P. Walsh
*Assistant Examiner*—Emmanuel M. Marcelo

(57) ABSTRACT

A failsafe device for raising/lowering articles includes a frame and a fastener for attaching the frame to a ceiling or wall to elevate an article above the floor. A pulley or sheave is mounted on the frame about a substantially horizontal axis when the frame is mounted on the ceiling or wall. A cable is entrained over the pulley and has a substantially vertical lifting cable portion attachable to the article to the lifted and a substantially vertical pulling cable portion arranged to be pulled downwardly by a user to elevate the article and raised upwardly to lower the article. A cam is mounted on the frame on one side of the pulling cable portion and has a cable engaging surface. The cam is movable between a cable releasing position and a cable locking position, the cable engaging surface including a first engaging portion normally spaced a fixed distance from the pulling cable portion to form a clearance gap in the cable releasing position and a second engaging portion bridging the clearance gap a distance equal to least the fixed distance for substantially instantaneously arresting the cable and preventing movement of the pulling cable portion upwardly toward the pulley and corresponding downward movement of the article. A pusher is mounted on the frame for always applying a force on the pulling cable portion in the direction of the cam for urging it across the clearance gap into contact with the first engaging portion only when tension in the pulling cable portion is decreased relative to the tension in the lifting cable portion, continued contact between the pulling cable portion causing the second engaging portion to bridge the clearance gap as it moves from the releasing to the locking positions until a tension is applied by the user to the pulling cable portion with a force that substantially corresponds to the weight of the article.

35 Claims, 15 Drawing Sheets

U.S. PATENT DOCUMENTS

| | | | |
|---|---|---|---|
| 1,132,571 | 1/1915 | Forsgard | 24/129 A |
| 1,167,295 | 1/1916 | Hall | 24/134 KB |
| 1,211,856 | 7/1917 | Johns | 248/320 |
| 1,366,212 | 1/1921 | Pollard | 24/129 B |
| 1,383,665 | 1/1921 | Roban | 24/129 B |
| 1,452,338 | 4/1923 | Flowers | 24/130 |
| 1,686,678 | 10/1928 | Burke . | |
| 1,735,691 | 11/1929 | Morgan . | |
| 2,200,896 | 5/1940 | Rio | 254/391 |
| 2,419,249 | 4/1947 | Bridges | 211/117 |
| 2,592,696 | 4/1952 | Hoody | 24/115 F |
| 2,631,803 | 3/1953 | Meyers | 248/328 |
| 2,867,875 | 1/1959 | Davison | 24/133 |
| 2,872,716 | 2/1959 | Ehmann et al. | 294/82.14 |
| 3,203,746 | 8/1965 | Shell | 312/201 |
| 3,215,385 | 11/1965 | Rockland | 248/317 |
| 4,007,808 | 2/1977 | Conley et al. | 182/142 |
| 4,057,211 | 11/1977 | Moore | 248/332 |
| 4,178,661 | 12/1979 | Klein | 24/130 |
| 4,280,435 | 7/1981 | Loomis | 24/129 B |
| 4,289,292 | 9/1981 | Kunjumon | 248/333 |
| 4,422,556 | 12/1983 | Moore | 211/119 |
| 4,502,668 | 3/1985 | Dodge | 254/391 |
| 4,542,884 | 9/1985 | Dodge | 254/391 |
| 4,934,660 | 6/1990 | Nelson | 254/394 |
| 5,067,621 | 11/1991 | Alexander | 211/117 |
| 5,526,944 | 6/1996 | Merl | 211/87 |
| 5,615,865 | 4/1997 | Fountain | 254/391 |
| 5,642,871 | 7/1997 | Repert et al. | 248/317 |
| 5,738,339 * | 4/1998 | Kuryu | 254/391 |
| 5,816,636 | 10/1998 | Gibson et al. | 294/82.14 |

* cited by examiner

FAILSAFE DEVICE FOR RAISING/ LOWERING ARTICLES

CROSS REFERENCE TO RELATED APPLICATION

This application is a continuation-in-part of U.S. patent application Ser. No. 08/984,023 filed on Dec. 3, 1997; now abandoned.

BACKGROUND OF THE INVENTION

1. Field of the Invention

The invention generally relates to lifting aids and, more particularly, to a failsafe device for raising/lowering articles.

2. Description of the Prior Art

There are devices known in the art for vertically raising/lowering an article, such as a monitor, a bicycle, a kitchen cabinet, a multi-level garment holder, or the like. These items normally rest on a bracket mounted on a wall, ceiling, or beam, or they may be mounted on a self-supporting vertically arranged framework. Some of these devices provide additional floor space under the raised article when the stored item is not needed. All include some form of hoisting means. Most of these devices are relatively expensive to manufacture, and are normally not sufficiently simple or safe enough in operation to also be used by children.

In U.S. Pat. No. 152,635 a pulley-block is disclosed in which the brake block follows the contour of the pulley. A spring biases the brake block to the cord-locking position so that the dropping of the article is arrested soon after the cord is released. However, to ensure locking of the cord it needs to be moved to an inclined position. The maximum stopping force is a function of the spring and the inclination of the cord to be controlled. If the spring is strong, however, high friction is applied on the cord in both directions. Additionally, to lower the article an additional cord must be pulled to remove the block from the braking position while the user simultaneously holds on to the main cord. Otherwise, the article would go into free fall and possibly cause injury or damage to the article. If the article is to be lowered a substantial distance the user would need to hold the brake block releasing cord with one hand and try to control the main cord with the other hand. This could be very difficult and inconvenient and could best be achieved with the aid of a second person who holds the releasing cord while the user uses both hands (hand-over-hand) to lower the article.

In U.S. Pat. No. 723,231 a pulley block is disclosed which also requires that the cable be manually inclined by the user to stop the movement of the cable, the degree of friction for arresting the cable being a function of the force with which the cable is inclined by the user. Release of the cable would result in free fall of the article.

In U.S. Pat. No. 826,727 a cloths line pulley is disclosed in which the cable is wedged between a pulley and a pawl. The greater the pressure on the pawl the greater the binding action. However, the pawl must be manually flipped to provide to described operation to lock the movement of the cord in one direction or the other.

In U.S. Pat. No. 916,091 a pulley and rope or cable holder is disclosed in which dual cams must be manually moved to provide locking action in either direction. A further pulley usable for clothes lines and lock for cables is disclosed in U.S. Pat. No. 1,107,934 in which a cam locks the cable when the cable is slack. Adjustments may be made depending on how tight or loose the cable is to lock with clothing on.

In U.S. Pat. No. 1,167,295 a pulley block is disclosed which requires lateral movements of the cable to inclined positions for locking the cable and, therefore, is similar to many of the aforementioned designs.

In U.S. Pat. No. 2,867,875 a cable clamp is disclosed in which the cable must be manually moved in relation to a stud on a pivoted lever to effect locking by wedging the cable against a jaw that is fixed during operation. Therefore, the device requires pulling of the cable laterally. While the cable may also be pulled downwardly there is a danger that the cable may re-engage if the user is not careful. While this device includes a cam it is in the form of a movable jaw that is fixed even if adjustable. Therefore, there is no element that tends to move toward a cable except for manual movements prior to use to accamodate the size of the cable.

In U.S. Pat. No. 5,615,865 a device is described that automatically engages and disengages a pawl and a lifting mechanism using the same. However, special stops are required to be placed on the cable. If the load is lifted and the pulling force is released the pawl engages the cable to prevent the load from falling. However, a stop on the cable must be moved to a position which tilts the lever to disengage the paws to allow the load to be lowered.

Clearly, the prior art devices frequently rely on special manipulations or movements by the user to arrest the downward movements of the article supported on a cable. However, such designs are not failsafe since error by the user could cause the article to drop uncontrollably. This may cause damage or injury. Additionally, with devices of the type under discussion a cable must be arrested immediately when released since the article may otherwise go into free fall and accelerate to a high velocity resulting in a high momentum. This makes it more difficult to stop the article instantaneously without creating substantial stress upon the cable and on the support surface that supports the device. This could result in damage to the support surface and, in fact, actually cause the device to separate from the support surface and, again, cause possible injury to personnel or damage to property.

SUMMARY OF THE INVENTION

Accordingly, an object of the present invention to provide a failsafe device for raising/lowering articles which does not have the disadvantages inherent in prior art devices.

It is another object of the invention to provide a failsafe device of the type under discussion which is simple construction and economical to manufacture.

It is still another object of invention provide a failsafe device as in the previous objects that is simple convenient to use.

It is yet another object of the invention provide a failsafe device of the type suggested the previous objects that ensures safe operation and substantially instantaneously arrests the movement of the article when the cord is released independently of any actions or inactions taken by user.

It is a further object of the invention provide a failsafe device as the previous object that may be used the raise/lower a number of articles having different sizes or shapes and suspended from one location or a number of location distributed or spaced from each other.

It is still further object of the invention to provide a raising/lowering device useful use with a wide variety of articles that are both light and heavy in weight, such as potted plants, bicycles, furniture, clothing, etc.

In order to achieve the above objects as well as others which will become apparent hereafter, a failsafe device for raising/lowering articles in accordance with the present invention comprises a frame. Attaching means is provided for attaching said frame to a support surface above a predetermined height to which the article is to be selectively elevated. Low friction deflection means is provided mounted on said frame about a substantially horizontal axis when the frame is mounted on the support surface. A cable is provided that is entrained over said low friction deflection means and has a substantially vertical lifing cable portion attachable to the article to be lifted and a substantially vertical pulling cable portion arranged the to be pulled downwardly by a user to elevate the article and released upwardly to lower the article. Cam means is provided on said frame on one side of said pulling cable portion and has the cable engaging surface. Said cam means is movable between a cable releasing position and a cable locking position. Said cable engaging surface includes the first engaging portion normally spaced a distance Δ from said pulling cable portion to form a clearance gap in said cable releasing position and a second engaging portion bridging said clearance gap a distance equal to at least Δ for substantially instantaneously arresting said cable and preventing movement of said pulling cable portion upwardly towards said friction deflection means and corresponding downward movement of the article. Pushing means on said frame on an opposing side of said pulling cable portion in relation to said cam means is provided for continuously applying a force on said pulling cable portion in the direction of said cam means and for urging said pulling cable portion across said clearance gap said distance Δ into contact with said first engaging portion only when tension in said pulling cable portion is decreased relative to the tension in said lifting cable portion. Continued contact between said pulling cable portion and said the cable engaging surface causing said second engaging portion to bridge said clearance distance Δ while said cam means moves from said releasing to said locking positions until a tension is applied by the user to said pulling cable portion that substantially corresponds to the weight of the article.

BRIEF DESCRIPTION OF THE DRAWINGS

The device for safely raising/lowering articles in accordance with the invention will now be described in detail in conjunction with the drawings, which illustrate presently prefer embodiments of the invention.

DESCRIPTION OF THE PREFERRED EMBODIMENTS

Figure 1:
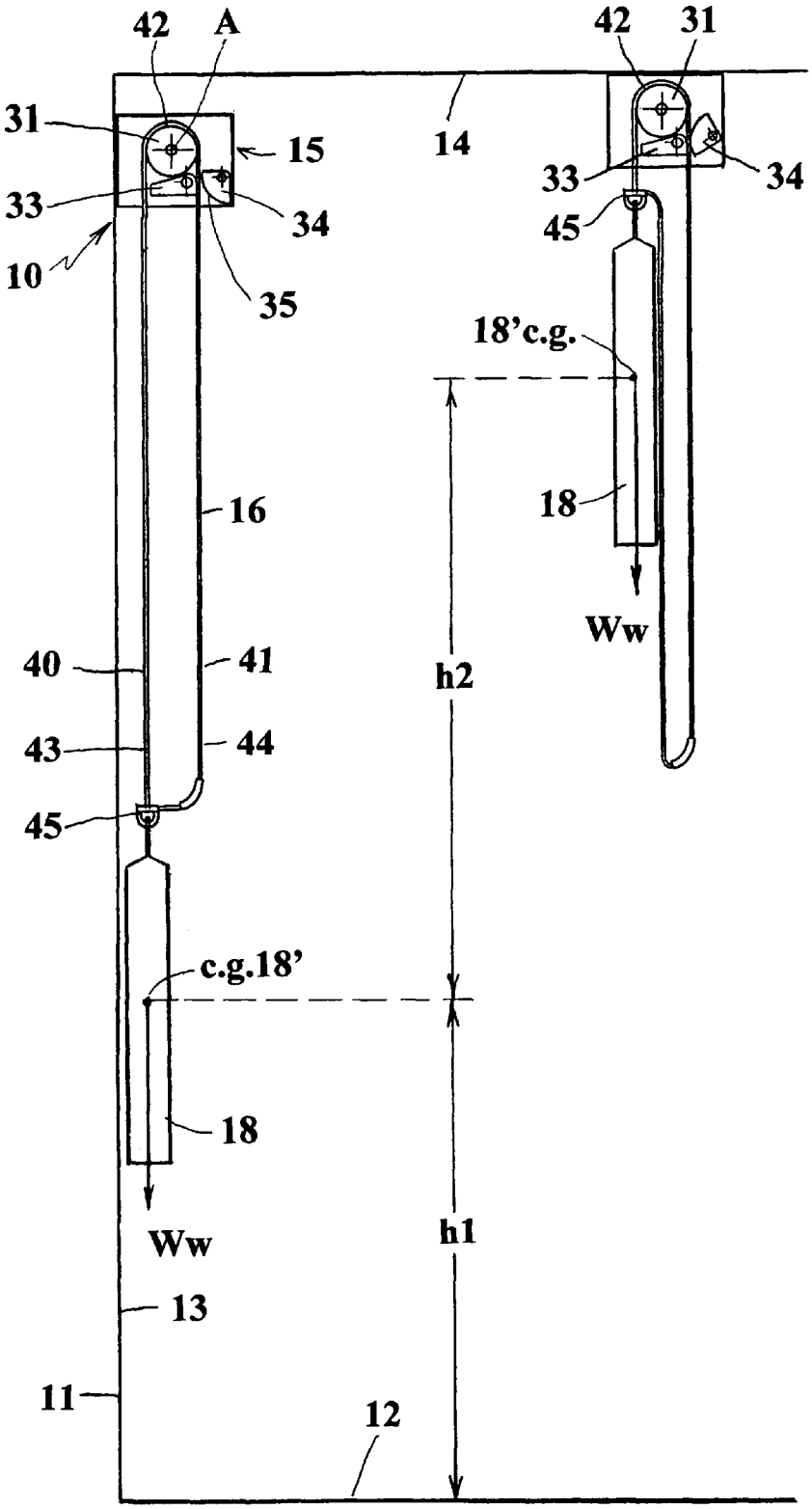
FIG. 1 are schematic representations of one failsafe device in accordance with invention mounted on a wall and another mounted on the ceiling, illustrating an article raised to different levels above a floor or reference level, illustrating the lower ends of the pulling side and the lifting side of the cable of tied or joined together.

Referring now specifically to the figures, in which identical or similar parts are designated by the same reference numerals throughout, and first referring to FIG. 1, a failsafe lifting device in accordance with present invention is generally designated by the reference numeral 10.

The lifting device 10 is primarily intended to be used within a room or enclosure 11 that has a floor 12, which serves as a reference height, a wall 13 and/or a ceiling 14. The lifting device 10 consists of two major components, a pulley assembly 15 and a cable, cord or rope 16.

Figure 2:
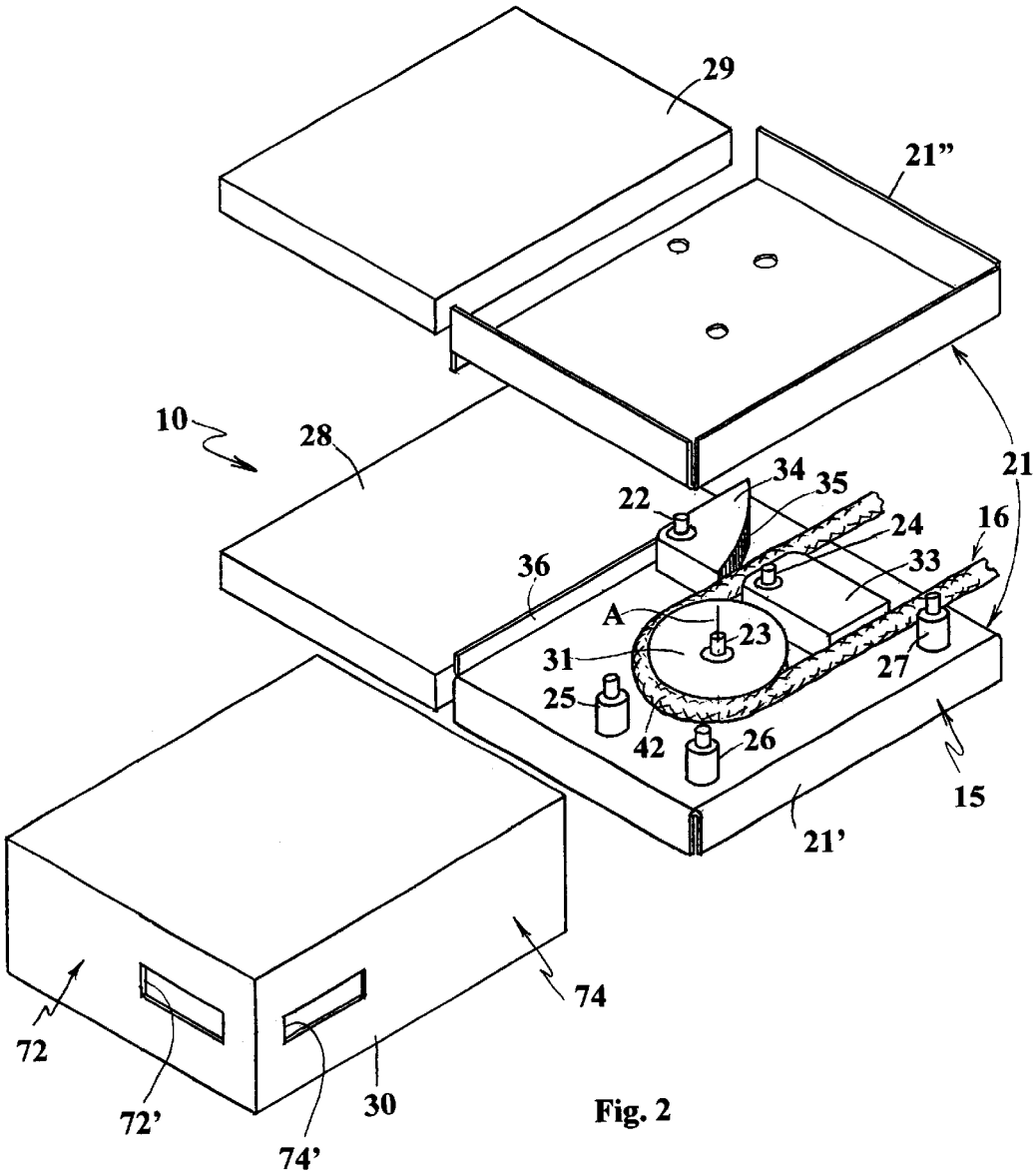
FIG. 2 is an exploded view, in perspective, of a device in accordance with the invention, shown disassembled to indicate the component parts.

Referring also to FIG. 2, the pulley assembly 15 includes a frame 21 comprising opposing like support panels 21', 21" and suitable attaching means, to be described, for attaching the frame 21 to a support surface, such as the wall 13 or the ceiling 14 above the floor 12 above which an article 18 is to be selectively elevated. The article 18 is in the form of a load or weight that has a center gravity 18' through which a weight component $W_w$ extends. The panels 21', 21" are shown formed of sheet metal, although other materials can be used. With the construction shown the exterior surfaces of the panels form spaces preferably filled with filler panels 28, 29 to form a generally solid exterior surface to both increase the aesthetic appearance of the unit or device and to facilitate the attachment of an exterior cover, as to be described.

A low friction deflection means 31 is mounted on the frame 21 about a substantially horizontal axis A when the frame is mounted on a support surface. The specific nature of the low friction deflection means 31 is not critical and any such means may be used. In the presently preferred embodiments, such low friction deflection means is in the form of a pulley or sheave. However, a smooth pin or roller may also be used, with different degrees of advantage. A cable, cord or rope is entrained over the sheave 31 and has a substantially vertical lifting cable portion 40, attachable to the article 18 to be lifted, and a substantially vertical pulling cable portion 41 is arranged to be pulled downwardly by a user to elevate the article and released or raised upwardly to lower the article.

Figure 3:
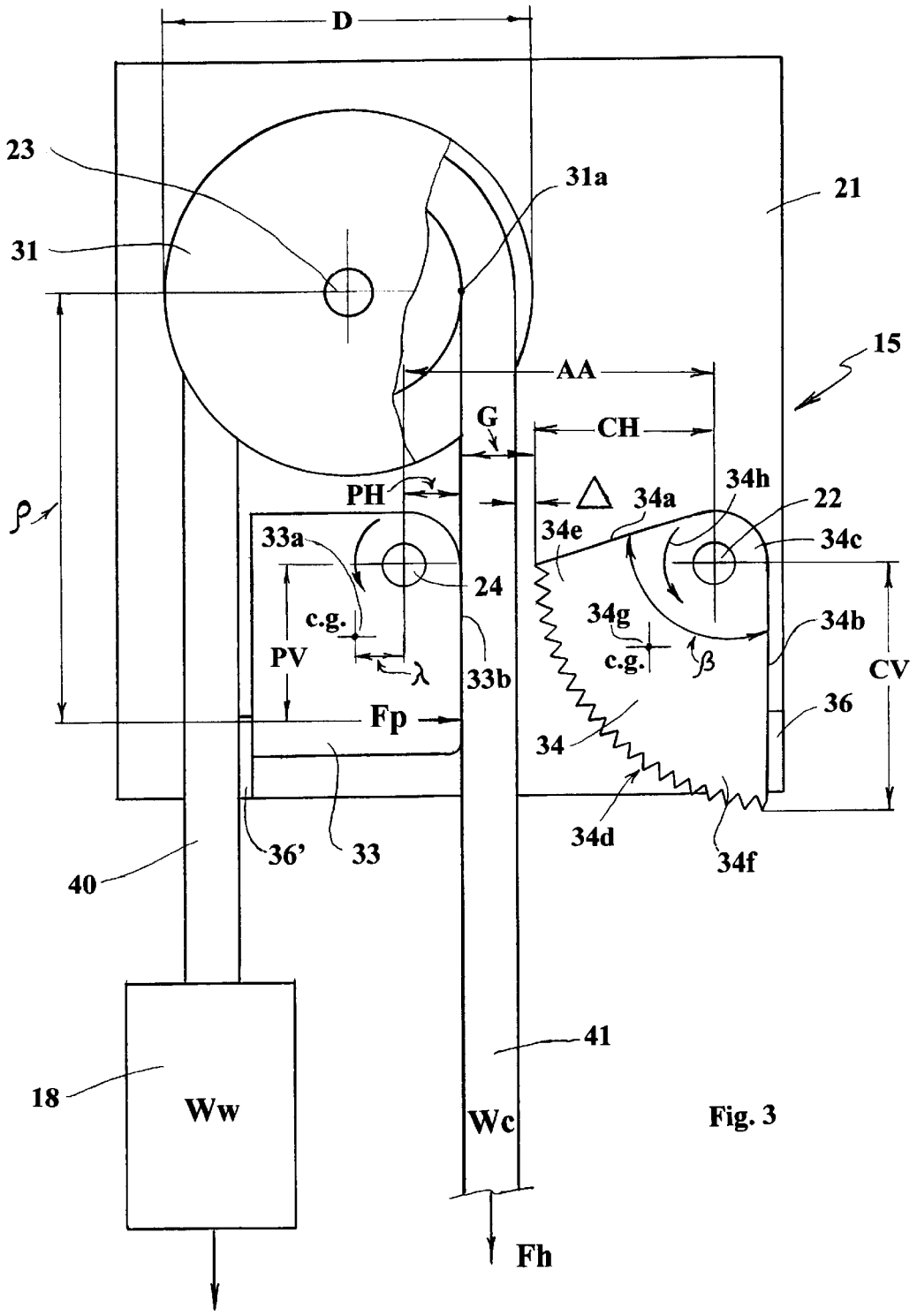
FIG. 3 is an enlarged side elevational view of a device in accordance with the invention, shown in the condition where a pulling force or tension is applied by the user during raising or lowering of an article and the cam is out of contact with the cable.
Figure 8:
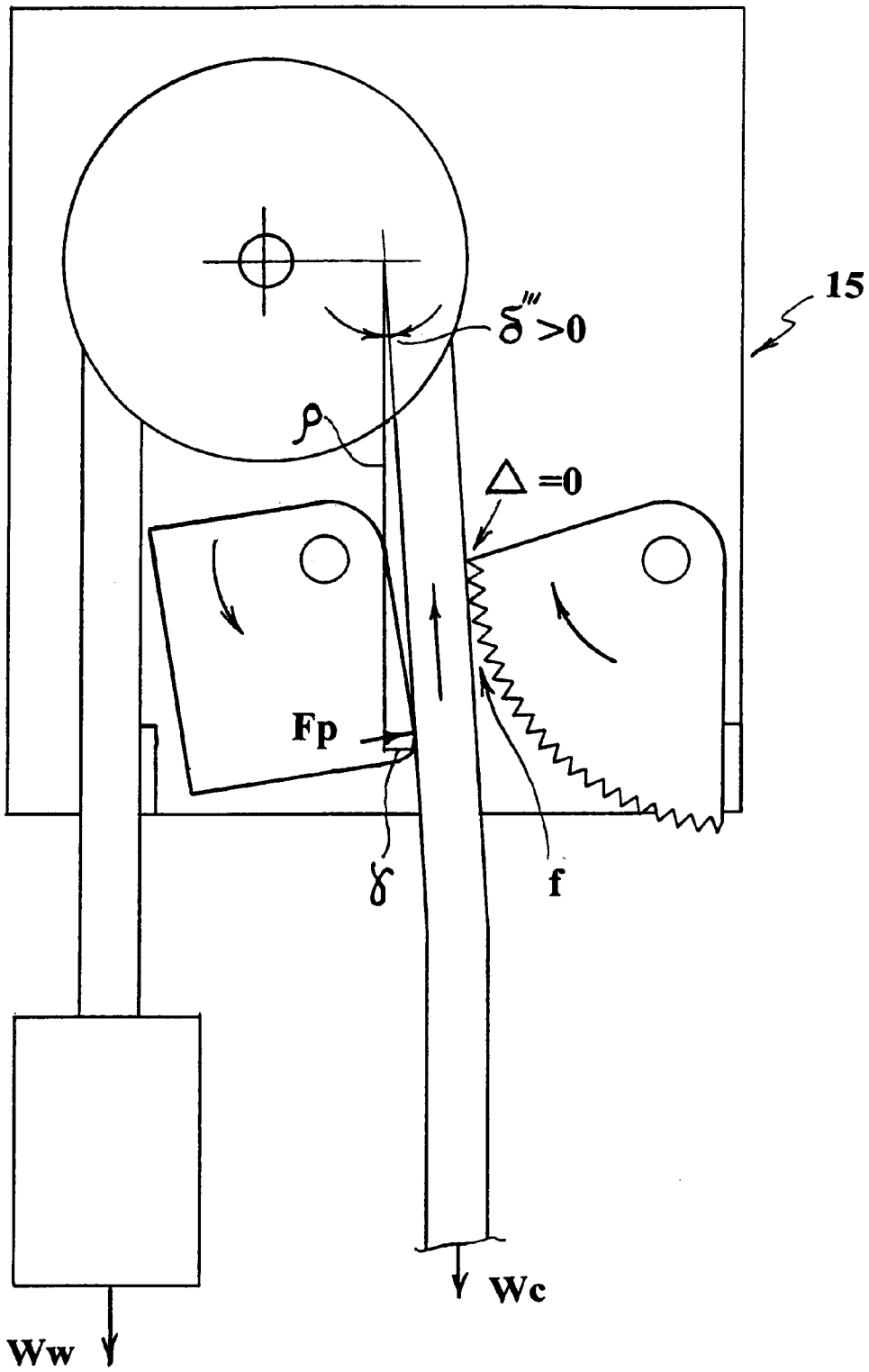
FIG. 8 is similar to FIG. 3 but showing the condition when the cable is initially released and the pusher urges the cable to engage the cam while the pulling cable portion moves upwardly to cause to cam to rotate or pivot in a clockwise direction to wedge the cable and arrest its continued upward movements.
Figure 9:
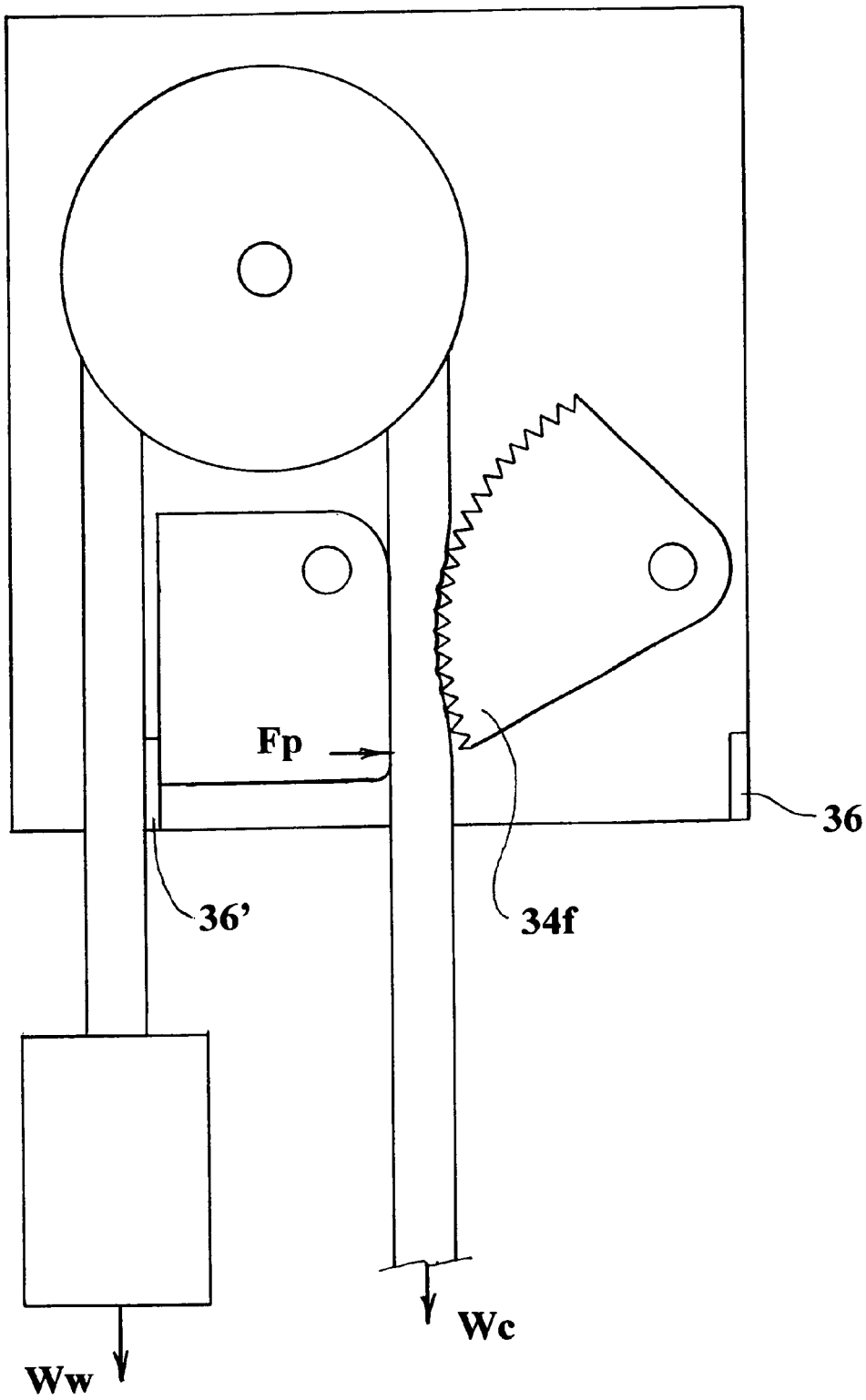
FIG. 9 is similar to FIGS. 3 and 8 illustrating the forces acting within the device just prior to the point when the pulling cable portion is fully arrested or locked.

Referring to FIGS. 2 and 3, a cam 34 is pivotally mounted on one side of the pulling cable portion 41 about a pin 22. The cam is generally shown to be in the form of a triangular segment having shorter and longer sides 34*a*, 34*b*, respectively, that form a vertex 34*c* having an angle β equal to somewhat less than 90 degrees. However, the specific angle is not critical. The triangular segment also includes an outwardly bowed, arcuate side 34*d* opposite the vertex, the shorter and longer sides 34*a*, 34*b* being proximate to the first and second engaging portions 34*e*, 34*f*, respectively, of the cam. The To center of gravity 34*g* of the cam 34 is disposed between the pulling cable portion 41 and pivot pin 22 so that the cam normally and naturally always tends to pivot in a counter-clockwise direction about the pivot in 22, as suggested by the arrow 34*h*, out of engagement with the pulling cable portion. A limit stop 36 prevents the cam 34 from pivoting counter-clockwise direction beyond the position shown in FIG. 3 in which the first engaging portion 34*e* of the cam engaging surface 34*d* is spaced a distance or forms a distance Δ from the pulling cable portion 41. The condition shown in FIG. 3 exists when a tension or force $F_h$ is applied to be pulling cable portion 41 to overcome the weight $W_w$ of the article 18. It is important that the distance Δ>0, although such distance may typically be within the range of 1 mm. In the position shown in FIG. 3 the cam 34 is in a cable releasing position. However, the cam 34 may be pivoted in a clockwise direction by causing the pulling cable portion 41 to engage the first engaging portion 34*e* along the initial or upper end of the surface 34*d*. and urging the surface upwardly (as viewed in FIG. 3) while the pulling cable portion 41 continues to move upwardly to a position shown in FIG. 8 to ultimately cause the second engaging portion 34*f* to bridge the distance Δ, as shown in FIG. 9, for compressing, gripping and substantially instantaneously arresting the pulling cable portion 41 and preventing it from moving upwardly toward the pulley or sheave 31 and corresponding downward movement of the article 18.

In order to insure that the pulling cable portion 41 automatically and almost instantaneously engages the initial engaging portion 34*e* of the surface 34*d*., there is provided, proximate to the shorter side 34*a*, a pusher 33 on an opposing side of the pulling cable portion 41 in relation to the cam 34 for always and continuously applying a force $F_p$ to the pulling cable portion 41 in the direction of the cam 34 (towards the right left as viewed in FIG. 3) and for urging the pulling cable portion transversely (horizontally) across the clearance or distance Δ into contact with the first engaging portion 34*e*, only when tension in the pulling cable portion is decreased relative to the tension in the lifting cable portion. Continued contact between the pulling cable portion 41 and the cable engaging surface 34*d* while the cable portion moves upwardly causes the second engaging portion 34*f*. to bridge the clearance distance Δ while the cam 34 moves from the releasing condition shown in FIG. 3 to the locking condition shown in FIG. 9—a condition that continues until a tension is applied by the user to the pulling cable portion 41 that substantially corresponds to the weight $W_w$ of the article 18. In the preferred embodiment, the pusher 33 and cam 34 are on diametrically opposite sides of the pulling cable portion 41, both being substantially in the plane of the sheave 31. Other relative positions of these components are, however, possible. As shown, the pusher 33 is presently mounted on a pivot pin 24 having an axis substantially parallel to the axis of the pin 22 and to the axis of the pin or shaft 23 on which the sheave 31 is rotatably mounted.

While in theory the pusher 33 and the cam 34 can be vertically spaced a considerable distance from the sheave 31, in the presently preferred embodiment these elements are in close proximity to the sheave for two primary reasons. The first is that this makes it possible to produce a compact pulley assembly 15. Additionally, as will be evident, the smaller the distance ρ between the tangent point 31*a* (FIG.3) at which the pulling cable portion 41 first makes contact with the sheave and the point at which the pusher 33 applies its biasing force $F_p$ quicker that the device will respond when the user releases the cable pulling portion. Thus, if the diameter of the sheave is D, it is preferable that the pusher and cam 33, 34 be horizontally spaced from each other and the pin 24 be spaced from the shaft 23 a distance on the order of magnitude of the diameter D of the sheave.

The arcuate or bowed surface 34*d*. is preferably non-smooth and provided with a friction generating finish that frictionally engages the cable on contact therewith when the pulling cable portion 41 moves upwardly towards the sheave 31. Such friction generating surface is shown in the form of short teeth in FIG. 3. Any other non-smooth or tacky surface, such as the use of knurling, can also be used.

As noted, the cam 34 is eccentrically mounted so that it has a tendency to normally rotate in a counter-clockwise direction until it is halted by a limit stop 36. Similarly, the pusher 33 is mounted eccentrically about the pin 24 as shown. The specific shape or configuration of the pusher 33 is not critical, as long as it does not contact or interfere with the lifting cable portion 40 and the center of gravity 33*a* is placed to the left the pin 24 axis a distance λ so that the pusher 33, as well, has a tendency to normally and continuously rotate or pivot in the counter-clockwise direction. To assure that the pusher 33 does not interfere with the lifting cable portion 40 an optional limit stop 36' may be provided between the pusher and the cable portion, particularly when these elements are in close proximity in a compact pulley assembly as shown in FIG. 3. Since the cam 34 and the pusher 33 are on opposite sides of the pulling cable portion 41 the pusher 33 always tends to rotate into abutment with the pulling cable portion 41 whereas the tendency of the cam 34 is to move away from such pulling cable portion. More specifically, the pusher 33 has a preferably flat and smooth or frictionless cable engaging surface 33*b* that faces the pulling cable portion 41 and the cam in the direction of the cam 34. An important feature of the invention is that such tendency or inclination of the pusher 33 force $F_p$ to move the pulling cable portion 41 into contact with the cam 34 occurs independently of the tension in the cable. As will be described, however, the effectiveness of such pusher in moving the cable portion 41 laterally, in a direction generally normal to its longitudinal length direction, at any given time will be a function of the tension in the cable.

Distance the AA between the axes of the cam and the pusher is equal to the sum of the distances, along a horizontal line as viewed in FIG. 3, of the G, the distance PH of the pusher axis to the pulling cable portion 41 and the distance CH of the first engaging portion 34*e* at the edge 34*a* and the axis of the pivot 22. Also, the distance G between the cable engaging surface 33*b* of the pusher and the first engaging portion 34*e* of the cam, at 34*a*, is substantially equal to the diameter of the pulling cable portion 41 and the distance Δ. The vertical cable engaging surface 33*b* has a length along the pulling cable portion 41 a distance PV greater than the sum of the distances PH and Δ. Additionally, the sum of the distances CH and Δ is less than the length CV of the side 34*b*, or the longer side of the cam. Further, the length CV is less than the sum of the length CH and G. These general relationships ensure that the cooperative elements normally operate to achieve the desired results.

An exterior cover or case 30 (FIG. 2) is preferably provided that covers or encloses the operative components in the pulley assembly. The cover or case may be decorative, as it will normally be the only component, with the exception of the cables, that will be visible within the enclosure or room. The cover or case includes peripheral walls including top wall 72 and side wall 74. A slot 72' is formed in the top wall 72 generally proximate to pin 25 to make it accessible through the slot. Similarly, a slot 74' is formed in the side wall 74 proximate to the pin 26 so that it is accessible. The attachment bolts are extended through one of the slots to selectively attach to one of the pins 25, 26 without the need to remove the cover.

Figure 4:
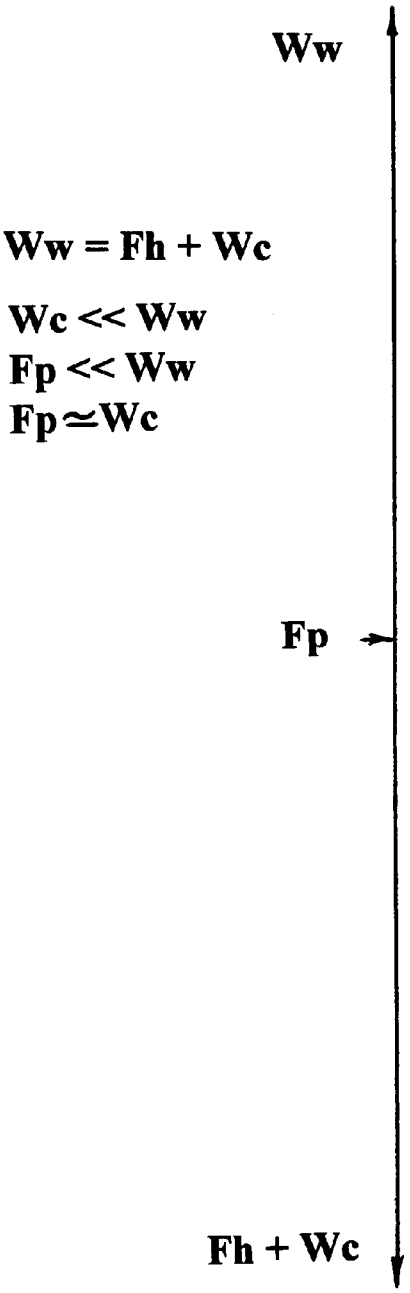
FIG. 4 is a force diagram corresponding to FIG. 3.
Figure 6:
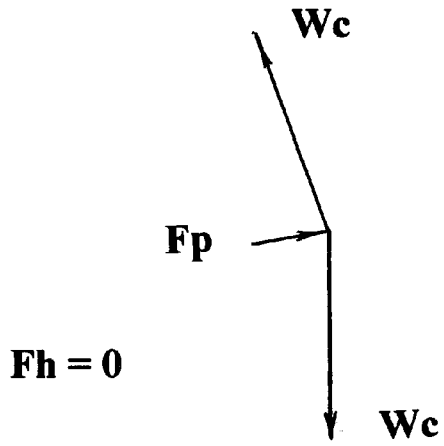
FIG. 6 is similar to FIG. 4 when the pulling force or tension applied by the user is removed and, therefore, the pulling cable portion is released.
Figure 5:
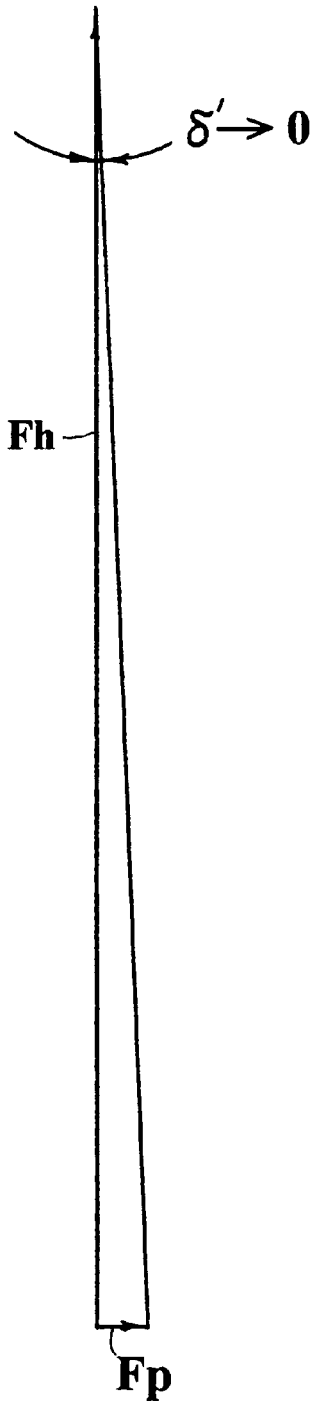
FIG. 5 is an exaggerated deflection diagram corresponding to the upper end of the force diagram shown in FIG. 4 to illustrate the deflection applicable when tension or pulling forces are applied to the cable by the user as shown in FIG. 3.
Figure 7B:
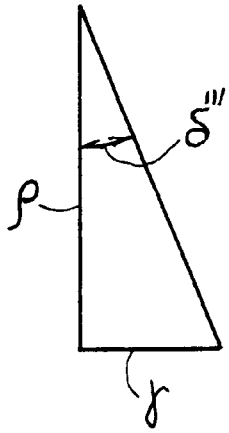
FIG. 7*b* is a physical deflection diagram corresponding to the force diagram shown FIGS. 6 and 7*a;*
Figure 7A:
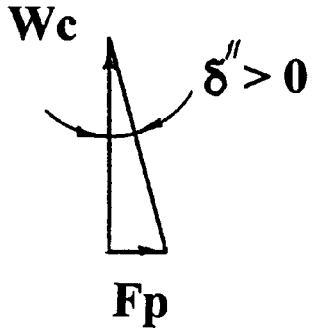
FIG. 7*a* is similar to FIG. 5 but corresponding to FIG. 6 when the pulling force or tension is eliminated.

Referring to FIG. 3, forces or tensions developed within the pulling cable portion 41 are depicted. At the top of the cable, where it engages the sheave, an upward force is applied to the pulling cable portion to offset the weight $W_w$ of the article and the weight $W_c$ of the pulley cable portion 41. Clearly, the weight $W_c$ is extremely small compared to the weight $W_w$ of the article, and the downward force $F_h$ applied by the user. From FIG. 5 it will be clear that the force $F_h$ is so much greater than the pushing force $F_p$ that the angle δ' approaches zero and is virtually undetectable. In FIG. 4, therefore, the forces are shown to be substantially aligned along a straight line and without any detectable deflection. In the exaggerated force diagram shown in FIG. 5 the angle δ' defined by the force vectors is shown to approach zero. However, as soon as the user releases the pulling cable portion 41 the tension or force $F_h$ is eliminated and the only force acting downwardly is the weight $W_c$ of the cable. Since the weight $W_c$ and the pushing force $F_p$ are much closer in magnitude (FIG. 6) the resulting angle δ" (FIG. 7*a*) defined by the force vectors becomes a more significant quantity and must be selected so that the pulling cable portion 41 is shifted a distance γ the towards the right, as viewed in FIG. 7*b*, at least a distance sufficient to cause at least that portion ρ (FIG. 3) of the pulling cable portion 41 to bridge the initial distance Δ and for coming into engagement with the initial engaging portion 34*e* of the cam surface along the side 34*a*. and forming a real angle δ'". It should also be evident that such cable portion 41 moves upwardly as shown in FIG. 8 in reaction to the dropping of the article 18. Once the vertical pulling cable portion 41 is in contact with the cam, as shown in FIG. 8, continued upward movement of such cable portion with continued biasing by the pusher 33 maintains such engagement with the cam and causes the cam to rotate in a clockwise direction. In doing so, successive portions of increasingly larger radii engage the cable and wedge the cable between the cam surface 34*d*. and the pusher 33. This continues until the condition shown in FIG. 9 is reached where the cam 34 is in the maximum clockwise position and the pulling cable portion 41 is typically substantially fully compressed between the pusher and the second cam engaging portion 34*f*. Once the cam can no longer compress the cable it will be fully wedged in place. The pusher and cam act very swiftly in moving from the initial position shown in FIG. 3 to the position shown in FIG. 8 and, ultimately, in FIG. 9. This is ensured by selecting a cam and pusher that have very low masses and, therefore, low inertia. These components, therefore, are extremely responsive and exhibit minimal delays in moving from one position to another. In this connection the cam and the pusher can be made from any suitable material, such as metal or plastic, as long as the pusher 33 can develop a force $F_p$, under the action of gravity, sufficient to overcome the weight $W_c$ of the pulling cable portion 41 and move it transversely across the distance Δ into contact with the cam 34. Importantly, movement of the pusher shifting the cable portion 41 across the distance Δ into contact withthe cam 34 is automatically achieved without any steps that need to be taken by the user. Thus, as soon as the user releases to pulling cable portion 41 it is substantially immediately arrested to prevent the article 18 from dropping into any extended free fall. Furthermore, because the cam and the pusher act so quickly and all the components are so close to each other, the pulling cable portion 41 is arrested almost immediately before the article 18 has an opportunity to develop any meaningful velocity and, therefore, momentum. This assures that stopping of the article while in motion creates the least shock forces or stresses to the supporting surfaces—either a wall or ceiling. Thus, it has been observed that the movement of the article 18 weighing approximately 15 pounds can be arrested within approximately 0.05 seconds. If the instant device is supported in ½ inch sheet-rock, which can support 60 pounds, it will be clear that the force exerted on the ceiling will increase to a maximum of twice the weight of the article—substantially less than the maximum load bearing capacity for such sheet-rock to provide a considerable safety margin. Greater loads can clearly be supported in sturdier support surfaces, such as ⅝" or ¾" sheet-rock. If the device is secured to a wood beam the safety margin is greatly increased and loads of up to 180 pounds does not present a problem, the cable becoming the weak link in the chain and more likely to fail than the support surface. It is anticipated that typical articles to be supported by this device will weigh the less than 10 pounds. With conventional devices, which allow articles to drop 1–3 cm the maximum force on the support surface can increase as much as six times the weight of the article. This can result in serious damage to the support surface and/or the article and, more importantly, injury to the user or to others. The rapidly acting present invention, which minimizes the time that the article has to accelerate, therefore increases the maximum weight that can be supported by any given support surface. The device, therefore, is not only easier and more convenient to use, but is also more reliable and safer to use with heavier loads.

Figure 10:
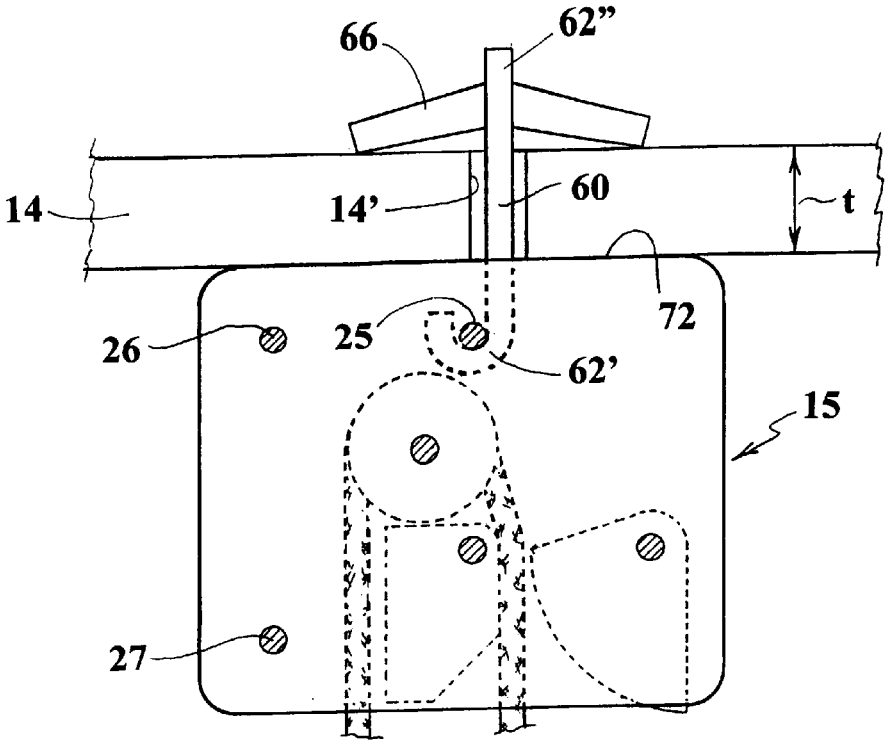
FIG. 10 is a side elevational view of the device, illustrating the manner in which it may be attached to a ceiling.
Figure 11:
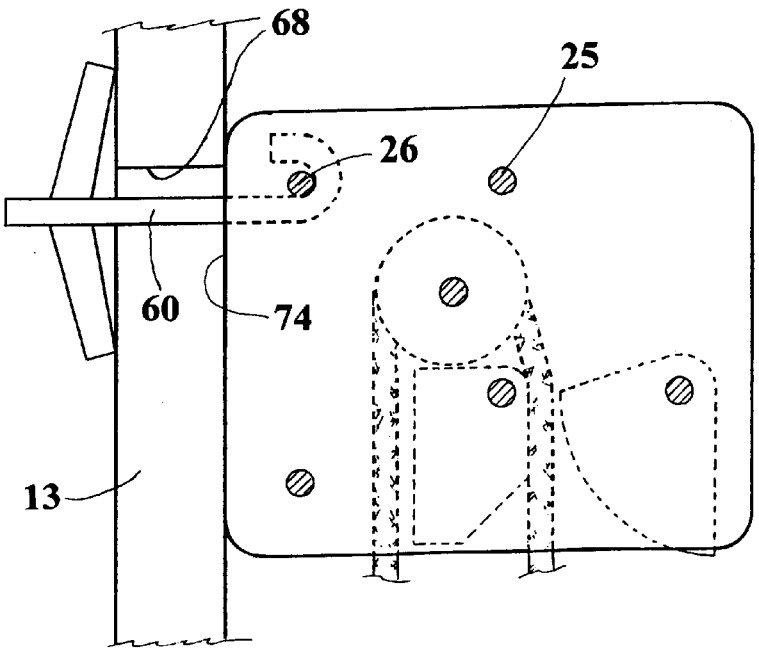
FIG. 11 similar to FIG. 10 but illustrating the device mounted on a wall.

The specific manner in which the pulley assembly 15 is attached to the support surface is not critical and any suitable, conventional method may be used. Referring to FIG. 10, the pulley assembly 15 is shown mounted on a ceiling 14 having a predetermined thickness t, such as ½ inch sheet-rock. A hole 14' is formed in the ceilings for receiving a "J" bolt 60 having a hook 62' for engaging a transverse support pin 25 and a threaded end 62" which extends through the hole 14' for engagement with a butterfly knot 66. By rotating the assembly 15 it is drawn against the bottom surface of the ceiling 14 until the top or horizontal surface 72 of the device is tightly abutting the against it. In FIG. 11, a similar device is shown mounted on a wall 13 provided with a hole 68 through which the same attachment or fastener device extends and engaged with a transverse support pin 26 proximate to the side or vertical edge 74 of the assembly 15 and tightly secured to the surface on which it is mounted as described above.

Figure 12:
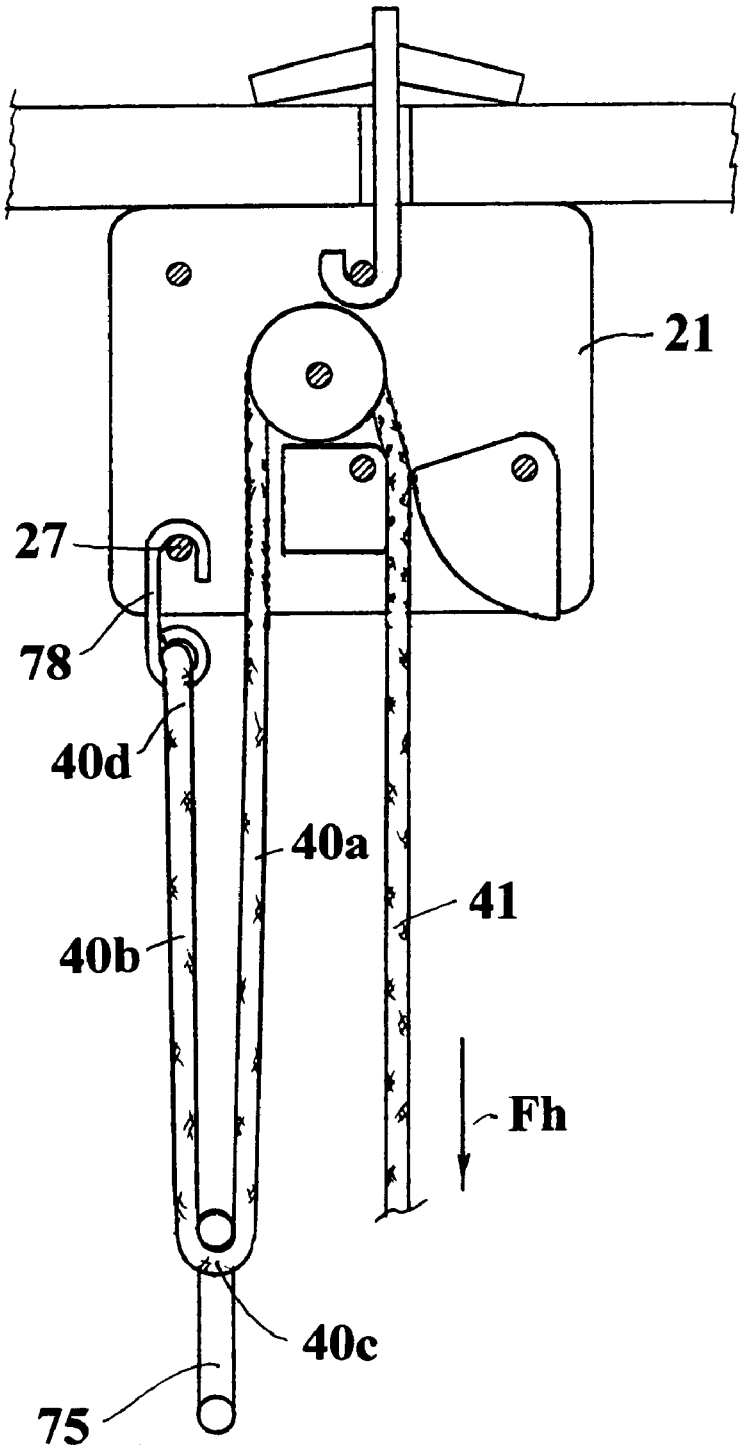
FIG. 12 is a side elevational view of the device in which the free end of the lifting cable portion is attached to the device to support a ring that can be moved upwardly and downwardly and to which an article may be attached.

Referring to FIG. 12, it is sometimes desirable to suspend an article from a ring 75. In accordance with the embodiment shown in FIG. 12 the frame 21 includes a transverse pin 27 spaced from the sheave as shown, the pin 27 serving as the securing means for securing the free end of the lifting cable portion 40 on the frame 21 to fold the lifting cable portion 40 into two generally adjacent leg portions 40*a*, 40*b* joined at a lowermost point 40*c* which extends through and supports the ring 75. In FIG. 12, the free end 40*d* of the cable portion 40 is secured to the pin 27 by means of any hook 78 attached to the free end 40*d*. It will be evident from FIG. 12 that pulling the cable portion 41 downwardly causes the lowermost portion 40*c* to rise and raise the ring 75. In this case $F_h$=½ $W_w$ due to the increased mechanical advantage provided by this arrangement.

Figure 19:
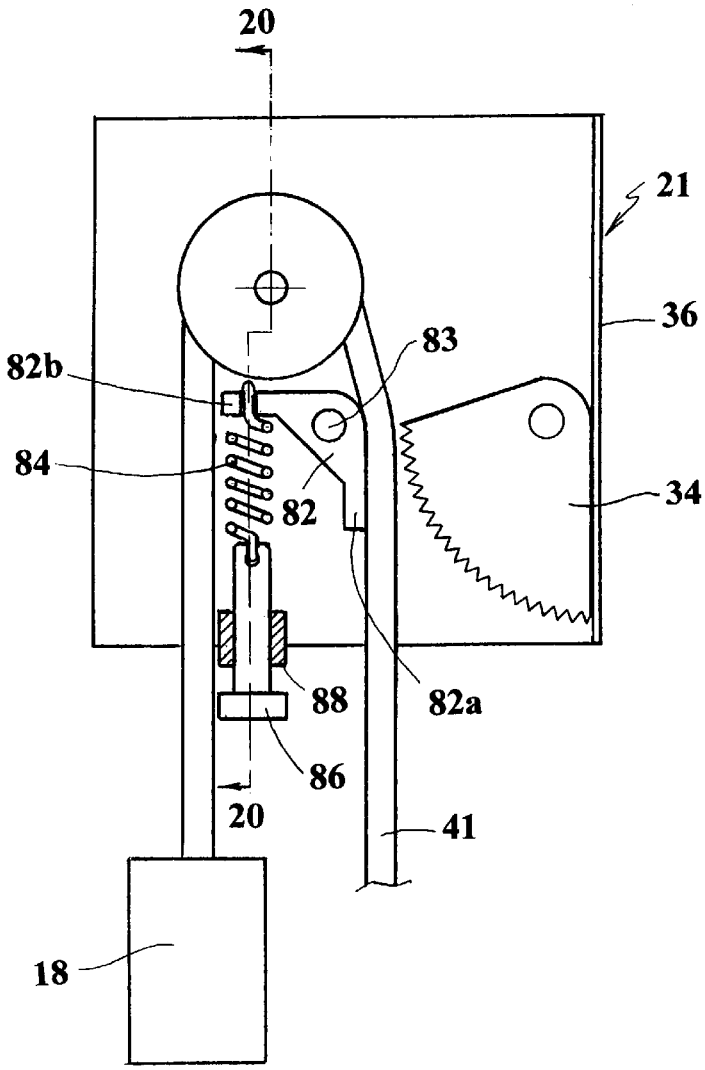
FIG. 19 is a front elevational view of a failsafe device in accordance with another embodiment of the inventions, in which the pusher is biased by a tension spring.
Figure 20:
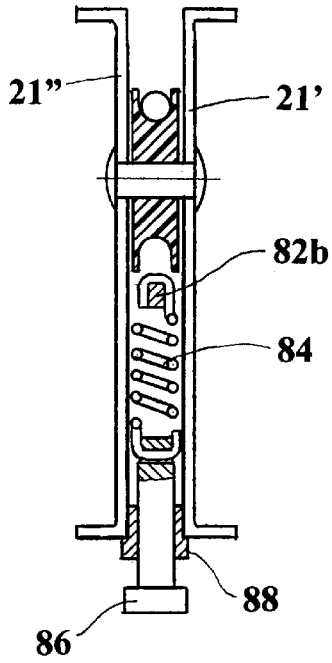
FIG. 20 is a cross-sectional view of the embodiment shown in FIG. 19, taken along line 20—20.
Figure 21:
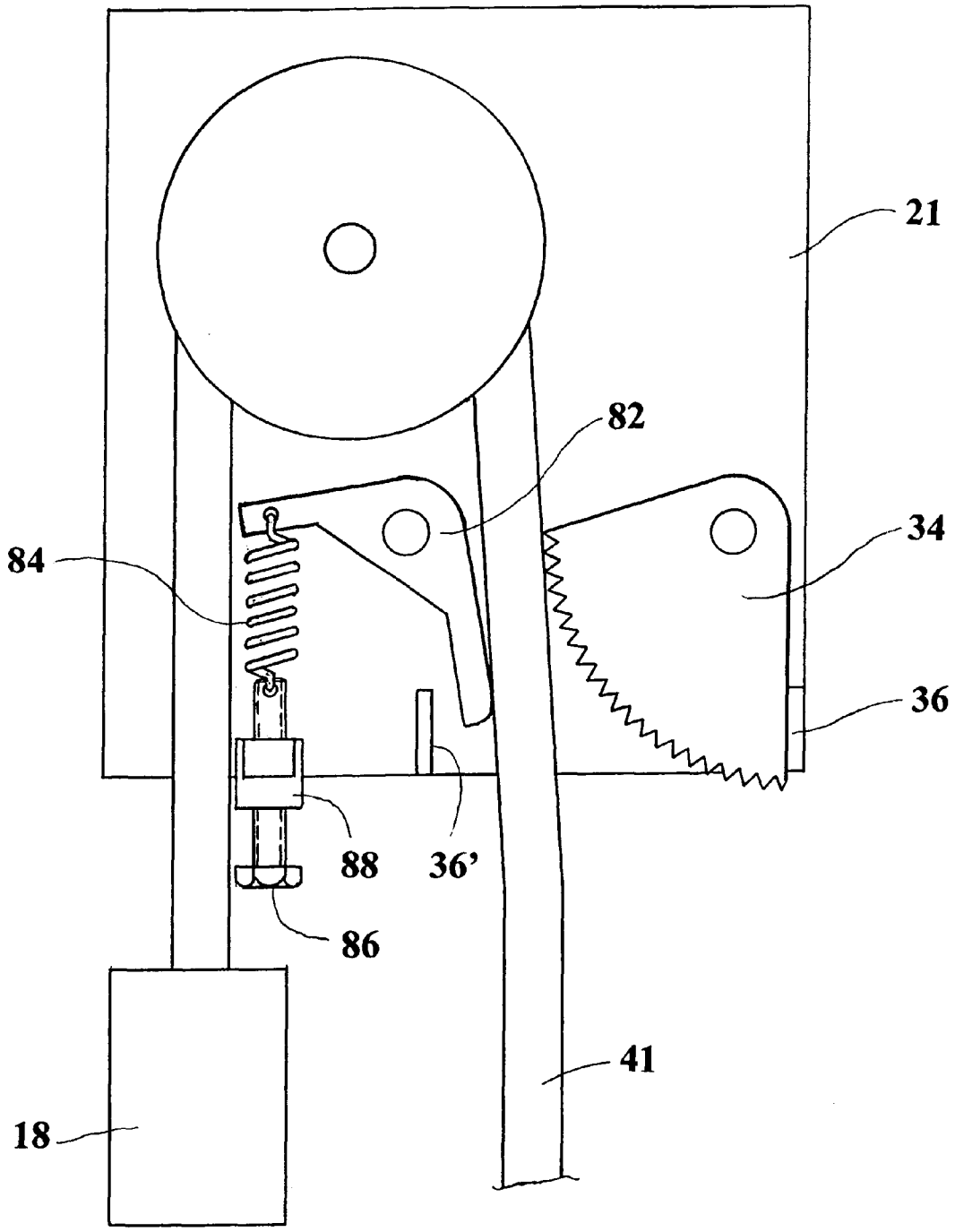
FIG. 21 is similar to FIG. 19 when tension on the pulling cable portion is removed to enable the pusher to deflect the cable into contact within the cam.
Figure 22:
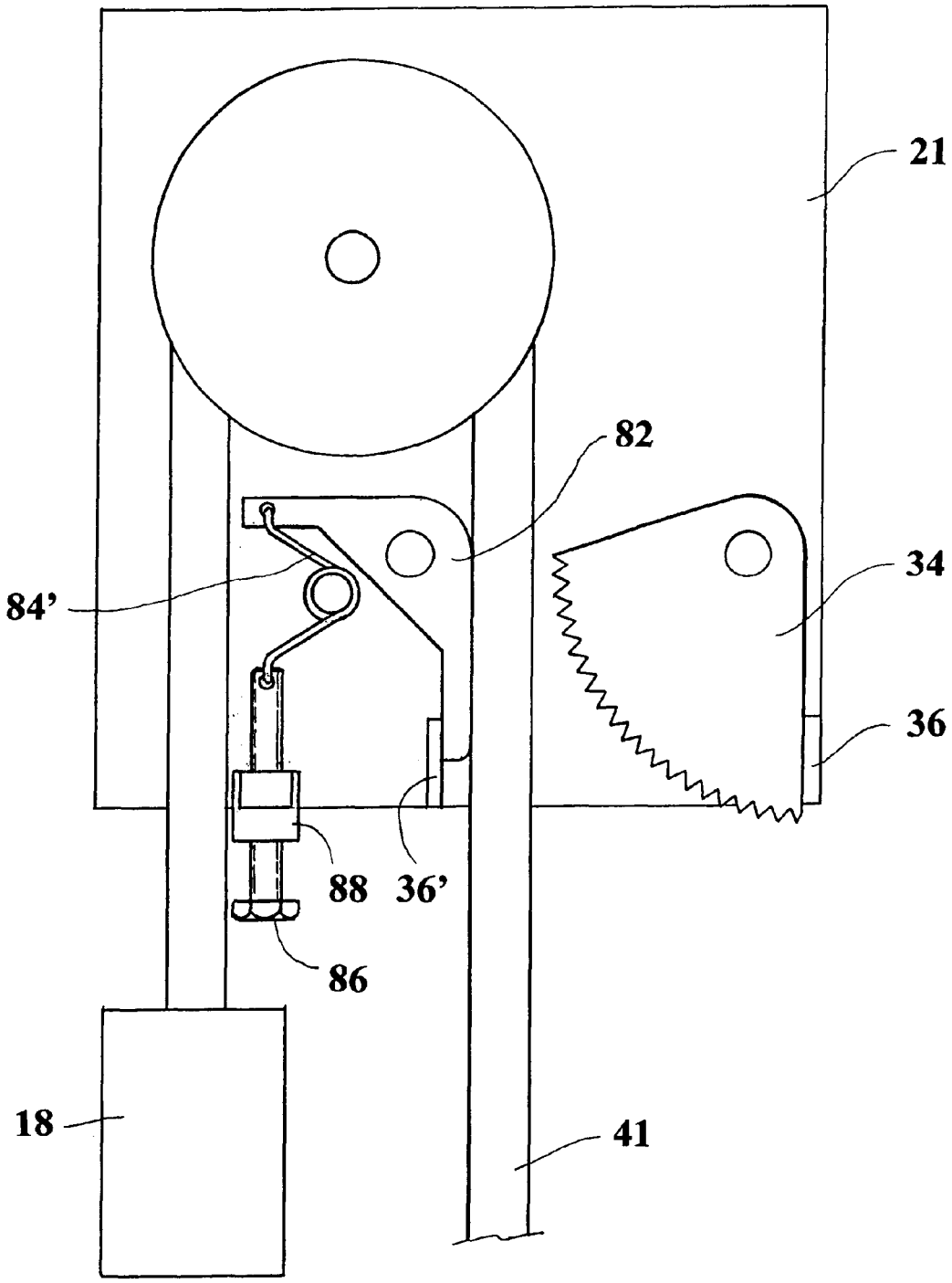
FIG. 22 is similar to FIG. 19, but illustrating a pusher employing a butterfly spring instead of a tension spring shown in FIGS. 19–21.

Referring to FIGS. 19 and 20, the pusher in accordance with another embodiment of the invention can include other pusher designs, such as pusher 82, shown as a triangular lever pivotally mounted on pin 83 and having one leg 82*a* in abutment with the pulling cable portion 41, while the other leg 82*b* is arranged to be pulled a tension spring 84 having one end engaged with the leg 82*b* while the other end of the spring is secured to a retainer 86 which may be adjustably mounted on a support block 88 on the frame 21. It should be clear, in this arrangement, the pusher 82 always urges the pulling the cable portion 41 towards the cam 34, as with previous embodiment. The benefit of this second embodiment is that the tension in the spring can be adjusted at will to select a force $F_p$ which will provide for optimum operation despite possible changes in variable parameters such as the different weights of various cords or cables that may be used. The operation is otherwise similar to that previously described, FIG.21 showing the movement of the pusher 82 when the user releases the pulling cable portion 41 to transversely displace it into contact with the cam. A similar arrangement is shown in FIG. 22, in which the tension spring 84 is replaced with a butterfly or leaf spring 84'.

Figure 13:
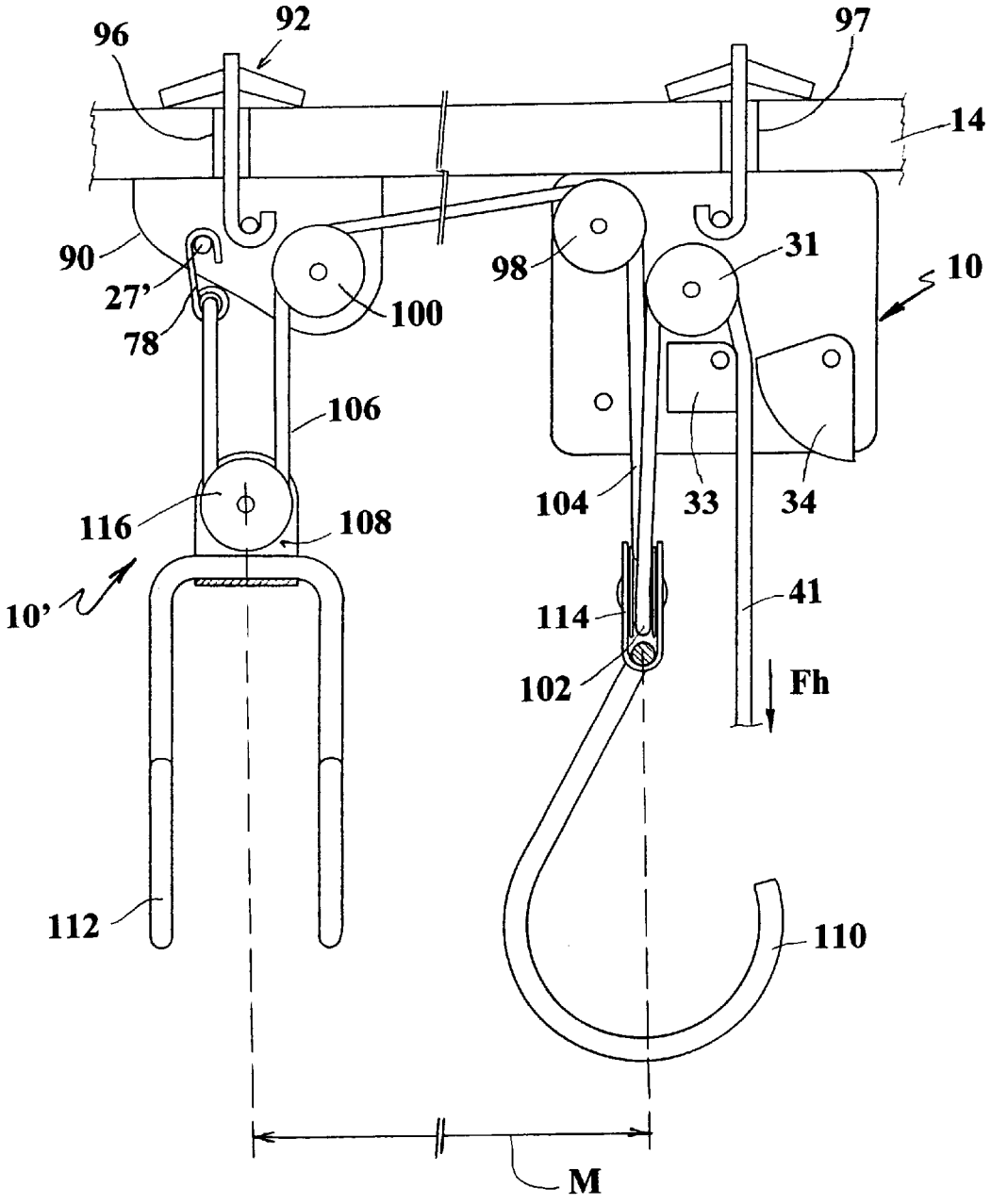
FIG. 13 is similar to FIG. 12, in which an accessory device is secured to a ceiling a distance spaced from the primary failsafe device, showing how the vertical lifting cable may be engaged within the various pulleys to permit two hooks to be elevated simultaneously, this being useful in raising certain larger objects or articles such as bicycles.

In FIG. 13, a modified form of the device is shown for use with a larger article that must be simultaneously lifted at two different points horizontally spaced from each other a predetermined distance M. The modified lifting device 10' includes an auxiliary pulley assembly 90 secured to the ceiling 14 by means of an attachment member 92, similar to that used for attaching the device 10 to the ceiling 14, in spaced holes 96, 97. Additional sheaves 98, 100 are similarly mounted as shown. As shown FIG. 13 a pin 27' is provided to which the free end of the cable is secured by means of the hook 78. The lifting cable portion is twice reversed upon itself to form suspended cable portions 104, 106 as shown at both pulley assemblies to form lowermost portions 102, 108 to support additional sheaves 114, 116. It will be evident that each of the hooks 110, 112 are suitable for attaching to a tubular member of a bicycle so that the bicycle can be raised by pulling the cable portion 41 by simultaneously raising both hooks 110, 112. It will be noted that in this arrangement, only the lifting device 10 includes a cable locking or arresting mechanism including a pusher 33 and cam 34 since the cable is continuous and arresting the cable pulling portion 41, between the pusher and cam, is adequate to effectively arrest the entire cable and the movement of the suspended article from further movements as soon as the user releases pulling cable portion 41, for reasons above described. In place of the hooks other engaging elements may also be used to accommodate differently shaped articles. Low friction pulleys facilitates the use of the compound device shown FIG. 13. In this case $F_h$=¼ $W_w$.

Figure 14:
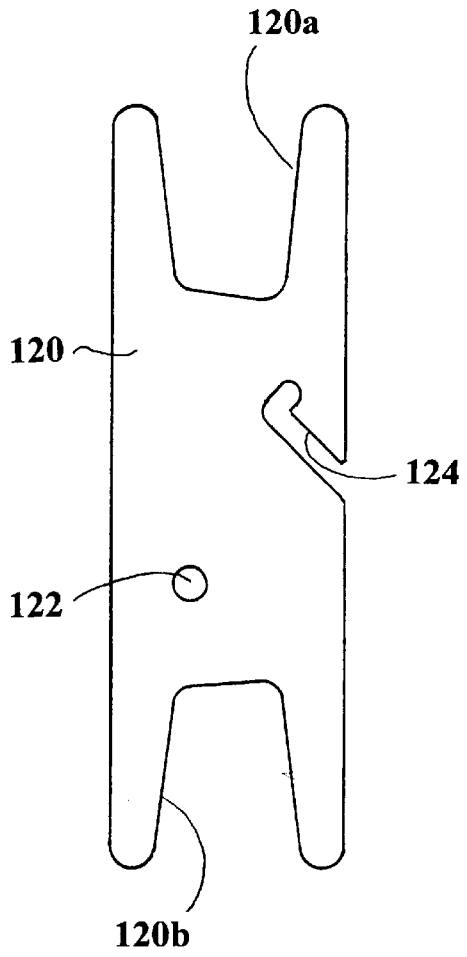
FIG. 14 is a front elevational view of a flat spool or cable length adjusting plate in accordance with the invention on which excess cord or cable can be wound and maintained.
Figure 15:
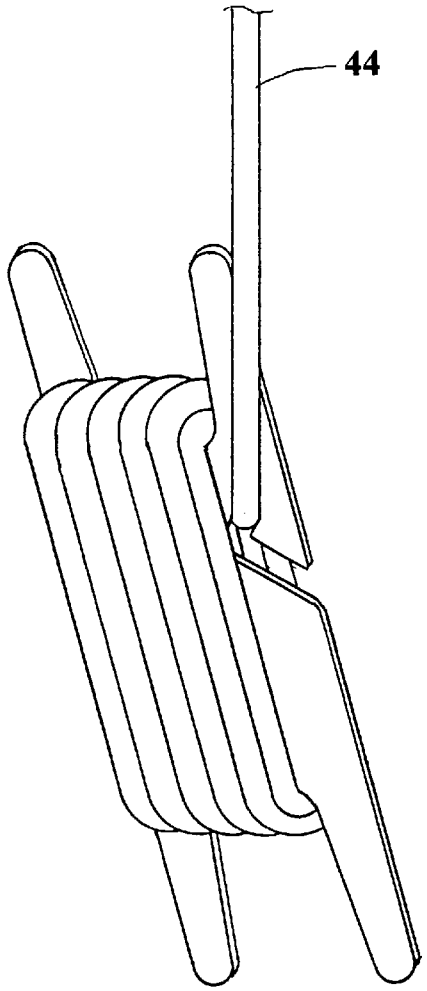
FIG. 15 is a perspective view of the spool shown FIG. 14, showing cord or cable wound thereon.

Preferably, a spool is used to avoid excess hanging cable when the pulling cable portion 41 is used to raise the article as shown in FIG 1. Referring to FIGS. 14, 15 a flat spool 120 is shown that can be used to accumulate excess cable. The flat spool 120 includes two opposing, generally U-shaped cutouts 120*a*, 120*b*, a hole 122 and an irregular slot 124 as shown. The free end of the cable is inserted through the whole 122 after which the cable is wound about the spool as shown in FIG. 15. Once the suitable amount of cable has been wound around the spool the cable can be the inserted into the L-shaped slot 124 to positively lock and retain the cable therein and prevent unwinding. While the locking mechanism in the preferred embodiment is in the form of at least one generally L-shaped slot 124 in the flat plate 120 it will be clear that any locking means can be used for this purpose, such as differently shaped slots, a clip attached to the plate or the like. In FIG. 1, the free end of the pulling cable portion 41 is attached to the free end of the lifting cable portion 40 by means of the tie or clip 45. However, this approach forms a closed loop that may be dangerous to young children. Prior art clips that exhibit such problems are disclosed in U.S. Pat. Nos. 604,339; 817,039; 829,320; 896,646; 1,132,571; 1,686,678; 1,735,691; 1,383,665; 1,366,212; 4,178,661; 1,452,338; 1,055,503; 2,592,696; and 4,280,435.

Figure 16:
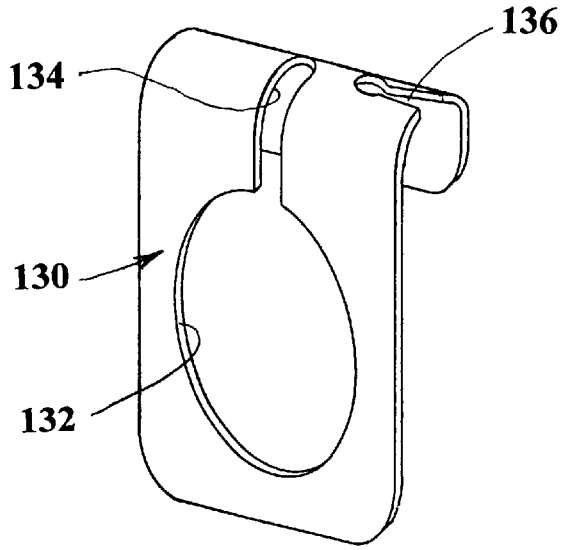
FIG. 16 is a perspective view of a tension-responsive self opening safety cable tie.
Figure 17:
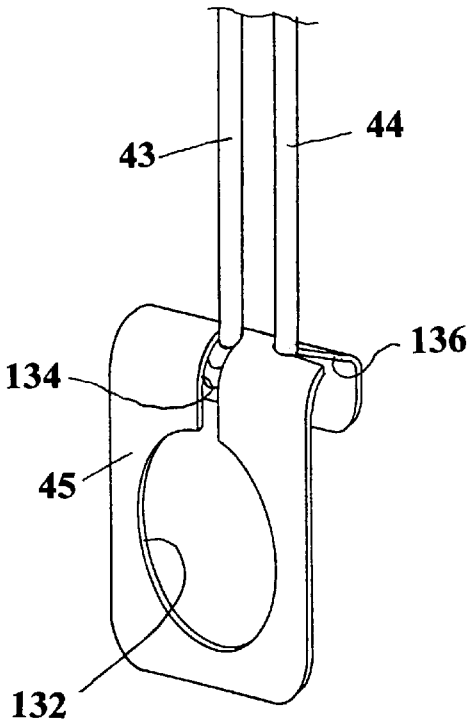
FIG. 17 is similar to FIG. 16, but showing the two free ends of the cable shown FIG. 1 to be received and retained within the slots of the cable tie.
Figure 18:
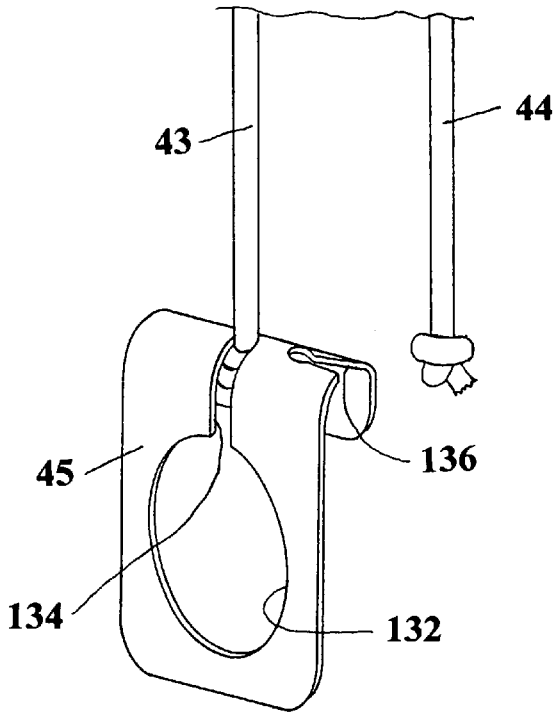
FIG. 18 is similar to FIG. 17, but showing one free end of the cable removed from the lateral slot to open the resulting loop when safety so requires.

When it is desired to use a tie as suggested in FIG. 1, a suitable tie 130 is shown in FIGS. 16–18 for attaching the free ends 43, 44 of the cable to each other in the proximity of the article. Preferably, the tie 130 is a tension responsive self opening safety cable tie that can separate the free ends and open the loop initially formed by the tie. The tie 130 is shown as a generally flat plate opened along one edge to provide a generally key-hole-shaped slot 136 having two inclined lead-in edges leading to a generally circular opening having a diameter substantially equal to that of the cable by means of a constricted neck portion less wide than such diameter. An opening 132 is provided in the plate for facilitating the support of an article, as with the ring 75 shown in FIG. 12, by allowing any article-supporting hook to be used A generally uniform slot 134 extends from the opening 132 into the region of curvature. The second slot 136 is formed in the region of curvature and generally normal to the slot 134. Each free end of the cable is formed with a knot received within a respective slot as shown. The tension applied to the lower or free ends of the cable urges the lower end 44 of the cable portion 41 to be pulled out of the slot 136, thus providing the desired safe operation. Thus, the cable portion 43 is subtantially permanently fixed to the tie, while the lower end 44 of the pulling cable portion 41 is detachably secured to the tie. As suggested in FIG. 1, the lower end 44 is attached to the tie at 45 so that it does not dangle below the article and may be removed from the space occupied by the user or others. The shape and dimensions of the slot 136 are selected to retain the cable except by application of manipulating forces of approximately 1–2 pounds. The benefit of the tie 130 is that if the loop shown in FIG. 1 is opened or broken there is no danger of the article falling and causing injury or damage by a dropping article since there is negligible tension in the pulling cable portion 41 and the pulley assembly 15 maintains the cam 34 in the locked position.

While the invention has been described with reference to illustrative embodiments, it is not intended that the novel device be limited thereby, but that modifications thereof are intended to be included within the broad spirit and scope of the disclosure and the following claims and the appended drawings.

What is claimed is:

1. A failsafe device for raising/lowering articles comprising a frame; attaching means for attaching said frame to a support surface above a predetermined height to which the article is to be selectively elevated; low friction deflection means mounted on said frame about a substantially horizontal axis when said frame is mounted on the support surface; a cable entrained over said low friction deflection means which has a substantially vertical lifting cable portion attachable to the article to the lifted and a substantially vertical pulling cable portion arranged to be pulled downwardly by a user to elevate the article and released upwardly to lower the article; cam means on said frame on one side of said pulling cable portion and having a cable engaging surface, said cam means being movable between a cable releasing position and a cable locking position, said cable engaging surface including a first engaging portion normally spaced a distance Δ from said pulling cable portion to form a clearance gap in said cable releasing position and a second engaging portion bridging said clearance gap a distance equal to least Δ for substantially instantaneously arresting said cable and preventing movement of said pulling cable portion upwardly toward said low friction deflection means and corresponding downward movement of the article; and pushing means on said frame on an opposing side of said pulling cable portion in relation to said cam means for continuously applying a force on said pulling cable portion in the direction of said cam and for urging said pulling cable portion across said clearance gap said distance Δ into contact with said first engaging portion only when tension in said pulling cable portion is decreased relative to the tension in said lifting cable portion, continued contact between said pulling cable portion and said cable engaging surface causing said second engaging portion to bridge said distance Δ while said cam means moves from said releasing to said locking positions until a tension is applied by the user to said pulling cable portion that substantially corresponds to the weight of the article.

2. The failsafe device as defined in claim 1, wherein said low friction deflection means comprises a sheave or pulley.

3. Failsafe device he defined in claimed 1, wherein said cam means and said pushing means are on diametrically opposite sides of said pulling cable portion.

4. Failsafe device as defined in claim 3, wherein said cam means and said pushing means are proximate to said low friction deflection means.

5. Failsafe device as defined in claim 4, wherein said low friction deflection means comprises a sheave or pulley having a predetermined diameter and said pusher and cam means are spaced from said horizontal axis a distance on the order of magnitude of the diameter of said sheave or pulley.

6. Failsafe device as defined in claim 1, wherein said cam means is formed with a friction generating surface for frictionally engaging said cable when in contact therewith and said pulling cable portion moves upwardly towards said sheave or pulley.

7. Failsage device as defined in claim 6, wherein said friction generating surfaces includes serrations or teeth.

8. Failsafe device as defined in claim 1, wherein said cam means comprises a generally triangular segment having shorter and longer sides forming a vertex including a predetermined angle and an outwardly bowed arcuate side opposite said vertex, said shorter and longer sides corresponding to said first and second engaging portions of said cam means.

9. Failsafe device as defined in claim 8, wherein said predetermined angle is approximately 90°.

10. Failsafe device as defined in claim 9, wherein said predetermined angle is less than 90°.

11. Failsafe device as defined in claim 8, wherein the sum of the length of said shorter side and Δ is less than the length of said longer side.

12. Failsafe device as defined in claim 11, wherein the length of said longer side is generally less than the sum of said shorter side, Δ and the transverse dimension of said cable.

13. Failsafe device as defined in claim 1, wherein said cam means comprises a cam that is pivotally mounted about a cam axis generally parallel to said axis of said low friction deflection means, said cam axis being proximate to a vertex formed by shorter or longer sides of said cam, said cam having a center of gravity between said pulling cable portion and said cam axis, whereby said cam normally tends to pivot in a direction out of contact with said the pulling cable portion to create said gap when a tension is applied to said pulling cable portion by a user to counter the weight of the article.

14. Failsafe device as defined in claim 1, wherein said pushing means comprises a pusher having a cable engaging surface facing said pulling cable portion and said cam means and said pusher being pivotally mounted about a pusher axis between said cable engaging surface and the center of gravity of said pusher, whereby said pusher normally causes said cable engaging surface to abut against said pulling cable portion in the direction of said cam means.

15. Failsafe device as defined in claim 14, wherein said gap between said cable engaging surface of said pusher and a first engaging surface of said cam is substantially equal to the diameter of said pulling cable portion and said distance Δ.

16. Failsafe device as defined in claim 14, wherein said cable engaging surface has a length along said cable pulling portion greater than the sum of the distances of said pusher axis from said pulling cable portion and Δ.

17. Failsafe device as defined in claim 1, wherein said cam means and pusher means are pivotally mounted about respective axes that are substantially parallel to said axis of said low friction deflection means.

18. Failsafe device as defined in claim 17, wherein the distance between said axes of said cam and pusher is equal to the sum of the distances, along a line generally transverse to a substantially horizontal line of said distance Δ, the diameter of said cable, the distance of said pusher axis to said pulling cable portion and said first engaging portion to said cam axis.

19. Failsafe device as defined in claim 1, wherein said attaching means comprises an accessible pin generally parallel to said horizontal axis mounted on said frame; and fastener means for engaging said accessible pin and drawing said frame to said support surface.

20. Failsafe device as defined in claim 19, wherein said fastener means comprises a butterfly bolt having a hook at one end to engage said accessible pin and a threaded end for engaging a butterfly nut.

21. Failsafe device as defined in claim 1, wherein the article is to be suspended from a ring, said frame including means for securing the free end of said pulling cable portion at a point generally proximate to said axis to form two generally adjacent leg portions joined at a lowermost portion which extends through and supports the ring.

22. Failsafe device as defined in claim 1, wherein said pusher means for comprises a movable pusher element; and biasing means for normally urging said movable pusher element into abutment against said lifting cable portion in the direction of said cam means.

23. Failsafe device as defined in claim 22, wherein said movable pusher element includes a lever having two spaced lever arms and pivotally mounted on said frame at a point intermediate to said of lever arms, one lever arm being arranged to abut against said lifting cable portion and said biasing means acting on said other lever arm.

24. Failsafe device as defined in claim 22, wherein said biasing means comprises a tension spring.

25. Failsafe device as defined in claim 22, further comprising adjustment means for adjusting the force normally applied by said pusher element on said lifting cable portion.

26. failsafe device as defined in claim 22, wherein said biasing means comprises a butterfly or leaf spring.

27. Failsafe device as defined in claim 1, wherein an article is to be simultaneously lifted at two points horizontally spaced from each other a predetermined distance, further comprising an auxiliary frame; attaching means for attaching said auxiliary frame to the support surface at said predetermined distance from the mounting position of said first-mentioned frame; additional low friction deflection means on said frame and said auxiliary frame; and means for securing the free end of a cable on said auxiliary frame; said lifting cable portion being reversed upon itself to form a first set of leg portions joined to each other at a first lowermost portion and extending over said additional low friction deflection means on both said frame and said auxiliary frame, the free end of said lifting cable portion being secured to said auxiliary frame by said securing means while forming a downwardly extending loop in which said lifting cable portion is reversed upon itself to form a second set of leg portions joined to each other at a second lowermost portion, each lowermost cable portion including engaging means for securing an article at separate horizontally displaced points; and an irregular lateral slot for positively receiving and retaining a portion of said pulling cable portion proximate.

28. A failsafe device as defined in claim 26, wherein said engaging means comprises a hook.

29. A failsafe device as defined in claim 27, wherein said hook is supported by a movable pulley supported by a respective lowermost portion of said cable.

30. A failsafe device as defined in claim 1, further comprising a spool for winding an excess free end of said pulling cable portion to avoid a long length of cable from being suspended from said frame.

31. A failsafe device as defined in claim 30, wherein said spool comprises a flat plate having opposing cutouts forming generally U-shaped receiving spaces for receiving a length of cable of said pulling cable portion and cable locking means on said flat plate for preventing said wound portion from inadvertently unwinding.

32. A failsafe device as defined in claim 31, wherein said locking means comprises and generally L-shaped slot formed in at least one of the lateral edges of said flat plate.

33. A failsafe device as defined in claim 1, further comprising means for attaching the free ends of said cable to each other in proximity of the article to cause the cable to be raised with the raising of the article.

34. A failsafe device as defined in claim 33, wherein said means for attaching comprises a tension responsive self opening safety cable tie to separate the free ends of the cable and open a loop initially formed by said attaching means.

35. A failsafe device as defined in claim 34, wherein said cable tie comprises a generally flat plate curved along one edge to provide a generally U-shaped cross-section and an opening in said flat plate, a first slot extending from said opening to said region of curvature and a second slot formed in the region of curvature generally orthogonal to said first slot, said slots being dimensioned to frictionally receive said cable but not a knot formed at a free end of the cable, each free end of said cable being formed with a knot and received within a respective slot.

* * * * *